US005375796A

United States Patent [19]

Turner et al.

[11] Patent Number: 5,375,796

[45] Date of Patent: Dec. 27, 1994

[54] RAILWAY SWITCH STAND HAVING SLIDE BLOCK ACTUATOR AND TWO INDEPENDENT OPERATING MECHANISMS

[75] Inventors: Charles W. Turner, Omaha, Nebr.; Michael K. Flaherty, Palatine, Ill.; Clarence L. Flessate, New Berlin, Wis.

[73] Assignee: Western States Supply, Omaha, Nebr.

[21] Appl. No.: 174,671

[22] Filed: Dec. 28, 1993

[51] Int. Cl.[5] ..... B61L 5/00

[52] U.S. Cl. ..... 246/257; 246/393

[58] Field of Search ..... 246/257, 393, 407, 410, 246/412, 415 R

[56] References Cited

U.S. PATENT DOCUMENTS

| | | | |
|---|---|---|---|
| 768,205 | 8/1904 | Thullen | 246/257 |
| 801,440 | 10/1905 | Colemar | 246/257 |
| 3,127,138 | 3/1964 | Wilson et al. | 246/393 |
| 3,136,509 | 6/1964 | Magnus | 246/393 |
| 3,363,097 | 1/1968 | Wilhelm et al. | 246/393 |
| 3,621,237 | 11/1971 | Hylen | 246/411 |
| 3,708,660 | 1/1973 | Speight | 246/393 |
| 4,022,409 | 5/1977 | Ensink et al. | 246/218 |
| 5,052,642 | 10/1991 | Peters | 246/393 |

FOREIGN PATENT DOCUMENTS

| | | | |
|---|---|---|---|
| 2122790 | 1/1984 | United Kingdom | 246/262 |

*Primary Examiner*—Robert J. Oberleitner
*Assistant Examiner*—S. Joseph Morano
*Attorney, Agent, or Firm*—Zarley, McKee, Thomte Voorhees & Sease

[57] ABSTRACT

A railway switch stand includes a reciprocating toggle arm which extends from the stand to operate a railway track switch between open and closed positions. The toggle arm has one end connected to a block which is operably mounted on the switch stand base for reciprocating forward and rearward movement. Forward and rearward brackets on the base prevent movement of the block beyond predetermined forward and rearward positions. An hydraulic cylinder connected to the block selectively moves the block between forward and rearward positions so as to reciprocate the toggle arm and throw the track switch. A pair of throw arms are pivotally disposed on opposite sides of the block relative to the blocks reciprocating path, with a forward end of the throw arm connected to the block. The throw arms include an extensible rod projecting from an elongated housing and biased forwardly therefrom, with the housing pivotally connected to the base plate, such that the biased extensible rods apply force to the block so that the block is in positive abutting contact with either the forward bracket or the rearward bracket.

10 Claims, 6 Drawing Sheets

RAILWAY SWITCH STAND HAVING SLIDE BLOCK ACTUATOR AND TWO INDEPENDENT OPERATING MECHANISMS

TECHNICAL FIELD

The present invention relates generally to railroad switch stands, and more particularly to an improved switch which may be hydraulically actuated and provide run through protection.

BACKGROUND OF THE INVENTION

Railway switch stands have been utilized on railroads for many years, and are the subject of a large number of patents. However, the current switch stands in operation still suffer several drawbacks. One major problem with present day hand-operated throw-type switches is in the many back and leg injuries to railroad personnel caused by the actual throwing of the switch. Such injuries can be quite expensive to the railroad in loss of personnel, and lawsuits brought by the injured persons.

Another problem with prior art switch stands is apparent in situations where a train runs through a switch which is in the wrong position. In such a case, the switch stand components are typically destroyed. Such switch stands are expensive to replace, and require time and labor of railroad personnel to install. Although prior art devices have utilized shear pins and the like to protect the major components of a switch stand in the event of a run through, there must still be a maintenance crew to repair the switch stand after the run through, as well as a certain amount of "down time".

While various types of electrical and hydraulic switches are known, such prior art switches are not capable of manual operation in the event of a loss of power, nor do they all provide desirable run through protection.

SUMMARY OF THE INVENTION

It is therefore a general object of the present invention to provide an improved railroad switch stand.

Another object of the present invention is to provide a hydraulically operated switch which allows a run through without destroying the switch stand.

A further object is to provide a switch which is capable of immediate reuse after a run through.

Still another object of the present invention is to provide a railroad switch which may be operated manually, independently of any power source for the switch. These and other objects of the present invention will be apparent to those skilled in the art.

The railway switch stand of the present invention includes a reciprocating toggle arm which extends from the stand to operate a railway track switch between open and closed positions. The toggle arm has one end connected to a block which is operably mounted on the switch stand base for reciprocating forward and rearward movement. Forward and rearward brackets on the base prevent movement of the block beyond predetermined forward and rearward positions. A hydraulic cylinder connected to the block selectively moves the block between forward and rearward positions so as to reciprocate the toggle arm and throw the track switch. A pair of throw arms are pivotally disposed on opposite sides of the block relative to the blocks reciprocating path, with a forward end of the throw arm connected to the block. The throw arms include an extensible rod projecting from an elongated housing and biased forwardly therefrom, with the housing pivotally connected to the base plate, such that the biased extensible rods apply force to the block so that the block is in positive abutting contact with either the forward bracket or the rearward bracket.

DESCRIPTION OF THE PREFERRED EMBODIMENT

Figure 1:
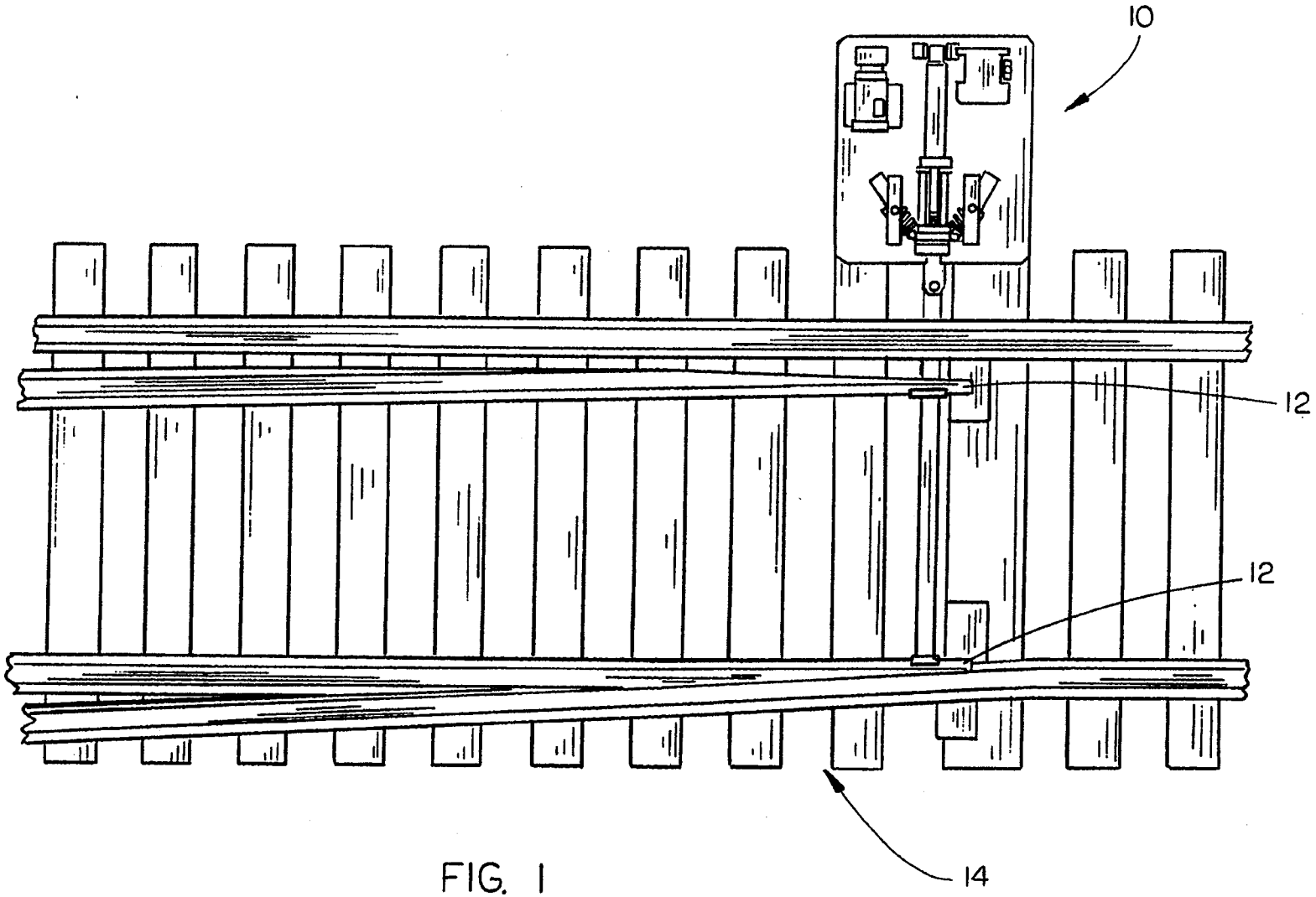
FIG. 1 is a plan view of the switch stand of the present invention connected to a conventional railroad switch.

Referring now to the drawings, in which similar or corresponding parts are identified with the same reference numeral, and more particularly to FIG. 1, the railroad switch of the present invention is designated generally at 10 and is shown connected to the rail points 12 of a railroad switch 14.

Figure 2:
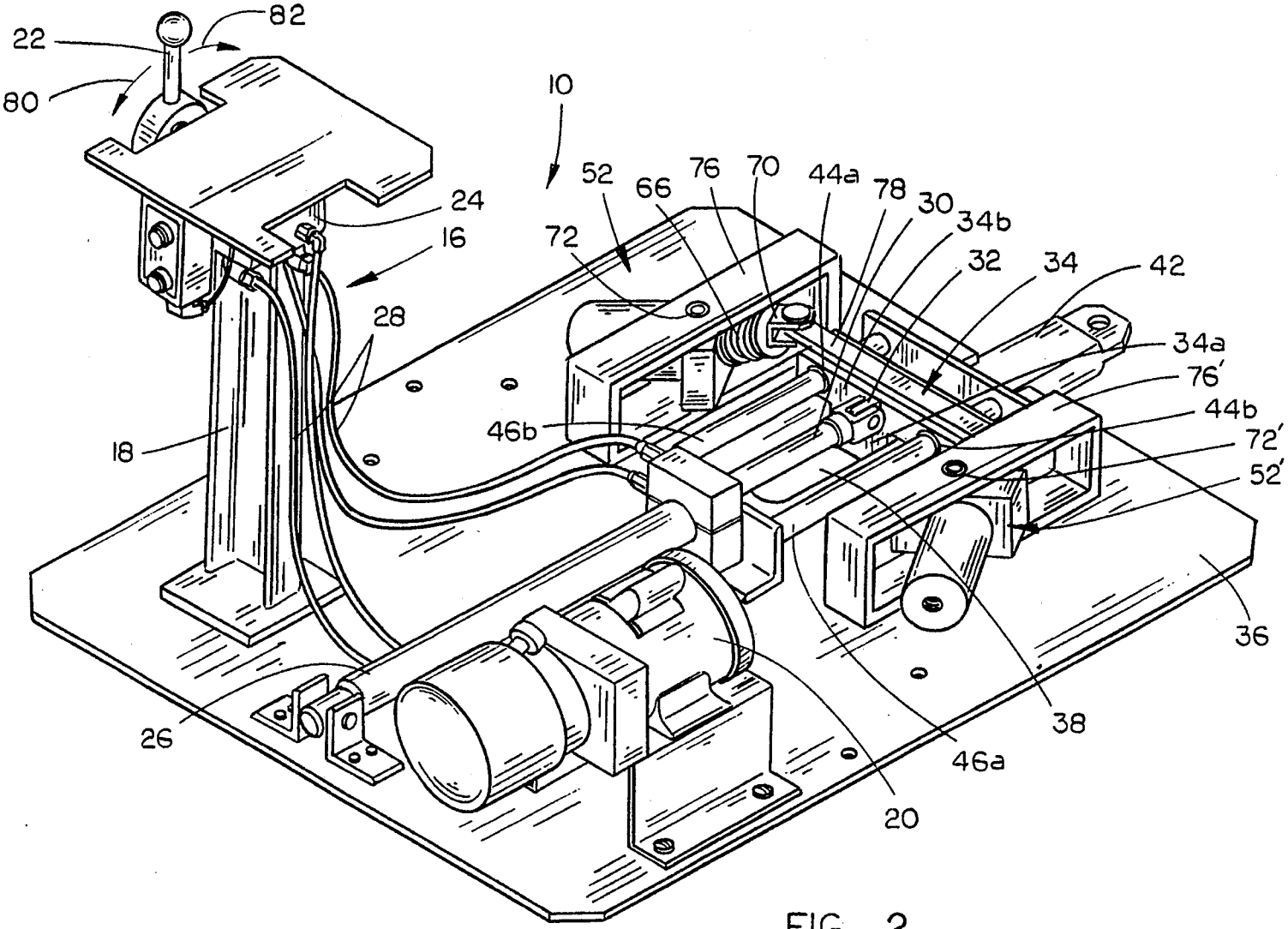
FIG. 2 is a perspective view of the switch of the present invention.

Referring now to FIG. 2, switch stand 10 includes a hydraulic control mechanism 16 on a support stand 18 and powered by motor 20. Control mechanism 16 includes a pivotable actuator lever 22 operably connected to a valve 24 which in turn is connected to a hydraulic cylinder 26 via hydraulic lines 28 to selectively extend or retract extensible arm 30 projecting from the forward end of cylinder 26. Preferably, lever 22 has a center neutral position, a forward position for extending arm 30, and a rearward position for retracting arm 30. The neutral center position places cylinder 26 in a neutral condition, such that train run-throughs will not damage the unit, as described in more detail hereinbelow.

The forward end of extensible arm 30 is pivotally connected to a rearwardly projecting ear 32 on a T-shaped block 34, to move block 34 forwardly and rearwardly on base plate 36. Block 34 includes a vertical stem portion **34*a* with a horizontal cross member 34*b* on the upper end of stem portion 34*a* to form a "T" shape. The lower end of stem portion 34*a* projects through an elongated slot 38 in base plate 36 and has a threaded aperture 40 therethrough for receipt of the threaded end of a conventional toggle arm 42. Cross member 34*b* has a pair of parallel apertures 44*a* and 44*b* formed therethrough which will receive guide rods 46*a* and 46*b*** therethrough.

Figure 3:
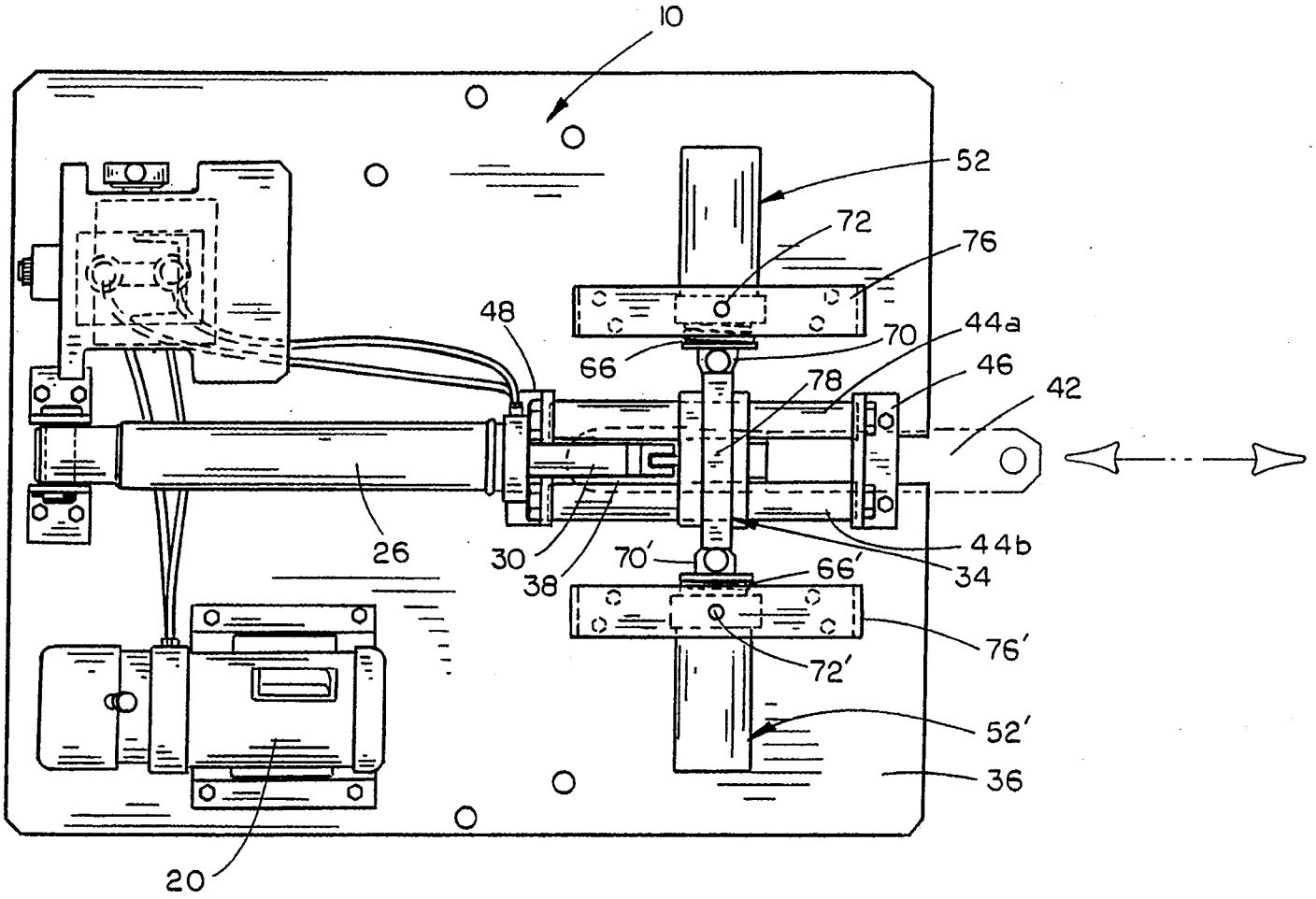
FIG. 3 is a top plan view of the switch shown in FIG. 2 with the switch in an intermediate position.

Referring now to FIG. 3, guide rods **44*a* and 44*b* are mounted in spaced apart parallel position between forward and rearward brackets 46 and 48. Rearward bracket 48 has an aperture therethrough, through which extensible arm 30 of cylinder 26 is journaled. Guide rods 46*a* and 46*b* serve to guide block 34 along slot 38, so as to extend or retract toggle arm 42**, thereby throwing a railroad switch in one direction or the other.

Figure 6:
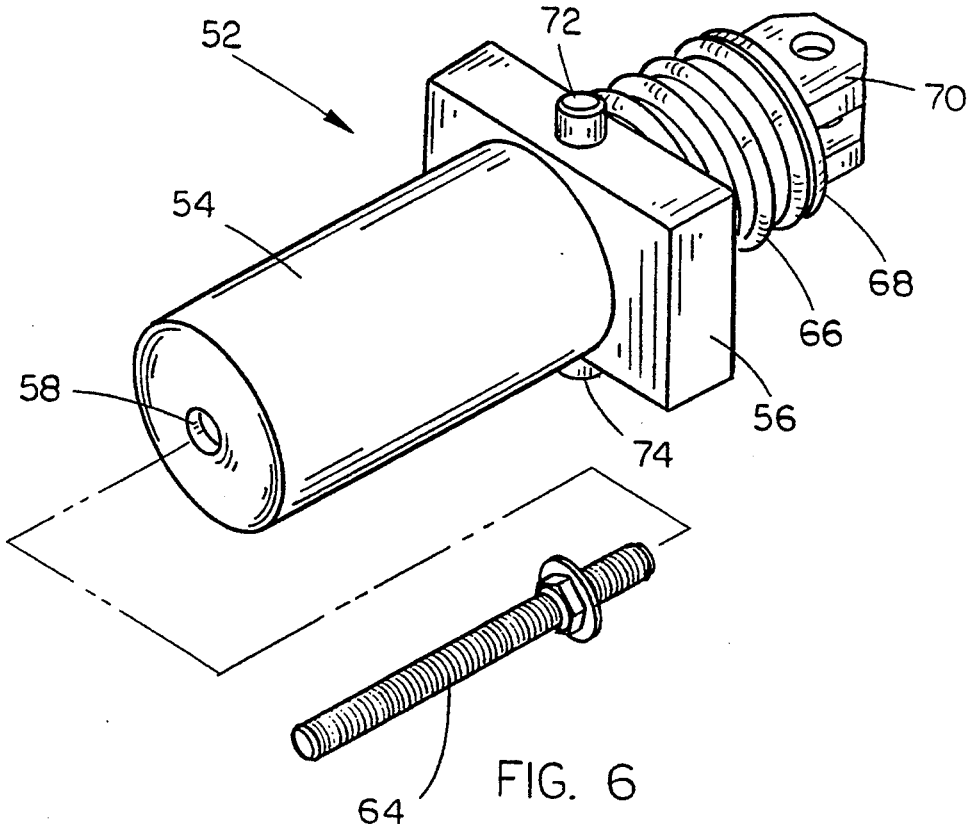
FIG. 6 is an enlarged perspective view of one of the two throw arms of the present invention.
Figure 7:
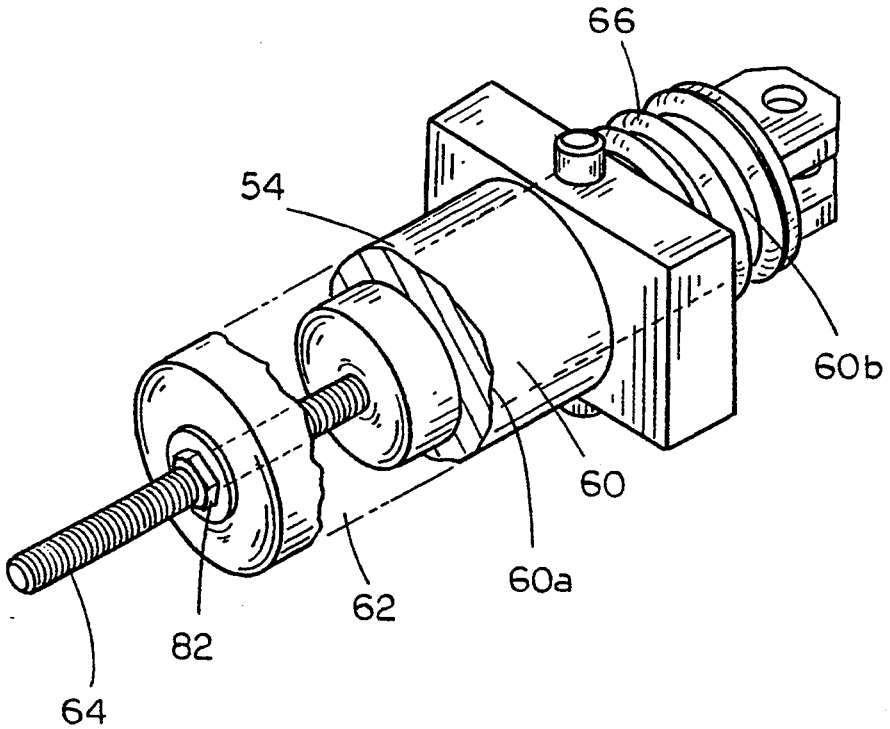
FIG. 7 is a perspective view of the throw arm of FIG. 6 with an adjustment mechanism attached thereto.
Figure 8:
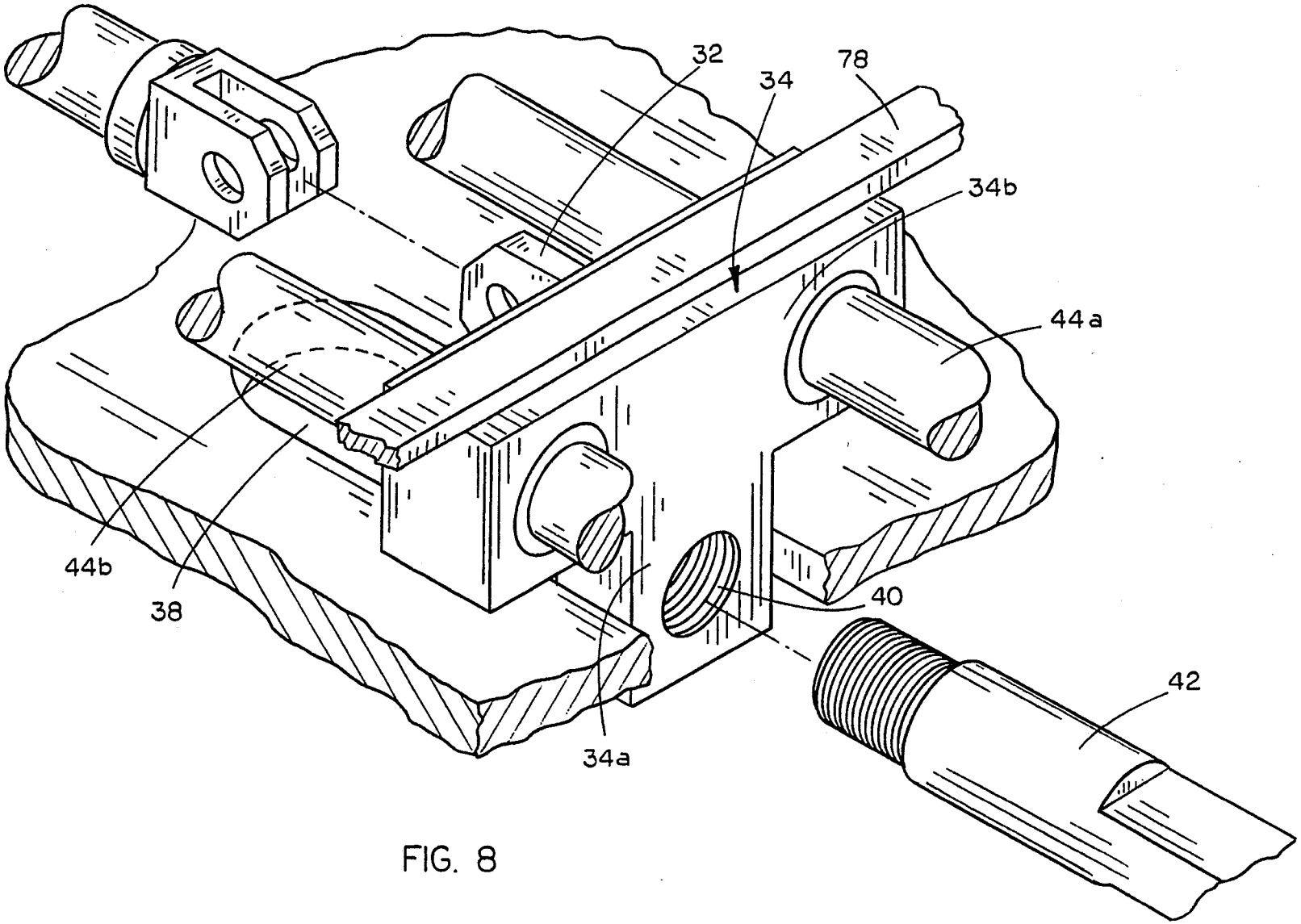
FIG. 8 is an enlarged perspective view of the sliding block for moving the toggle arm.

Because hydraulic cylinders and similar mechanical mechanisms are subject to potential leakage or failure, a pair of spring-loaded throw arms 52 and 52' are provided to provide a positive biasing force to ensure that a railroad switch is positively thrown in one direction or the other. As shown in FIGS. 6 and 7, each throw arm includes a cylindrical housing 54 with a vertical plate 56 mounted at the forward end, and an aperture 58 formed in the rearward end. Housing 54 is hollow and receives the rearward end 60*a* of a rod 60 slidably therein. The rod rearward end 60*a* includes a threaded aperture 62 which will receive a threaded shaft 64 during assembly, as described in more detail hereinbelow. The forward end 60*b* of rod 60 has a coil spring 66 journaled thereon which contacts the forward face of plate 56. The forward end of spring 66 is in contact with a stop plate 68, mounted on the forward end of rod 60. Thus, coil spring 66 serves to apply a forward biasing force on stop plate 68, and resists rearward movement of rod 60 into housing 54. A clevis 70 is mounted on the forward end of rod 60, forwardly of stop plate 68, and is pivotally connected to block 34, as discussed hereinbelow. An upper pivot pin 72 is mounted coaxially with a lower pivot pin 74 in the lower and upper ends of plate 56, as shown in 56, pins 72 and 74 forming a vertical pivotal axis for throw arm 52 once installed on switch stand 10.

Referring now to FIG. 3, throw arms 52 and 52' are pivotally mounted to switch stand 10 on an open rectangular frame 76 and 76'. As shown in FIG. 2, a pair of coaxially apertures in frames 76 and 76' receive the pivot pins 72, 72', 74 and 74', such that throw arms 52 and 52' pivot about a vertical axis. Each clevis 70 and 70' is pivotally connected to one end of a bar 78 mounted on block 34, such that movement of block 34 within slot 38 will move clevises 70 and 70' thereby pivoting throw arms 52 and 52' on pins 72 and 72'.

Figure 4:
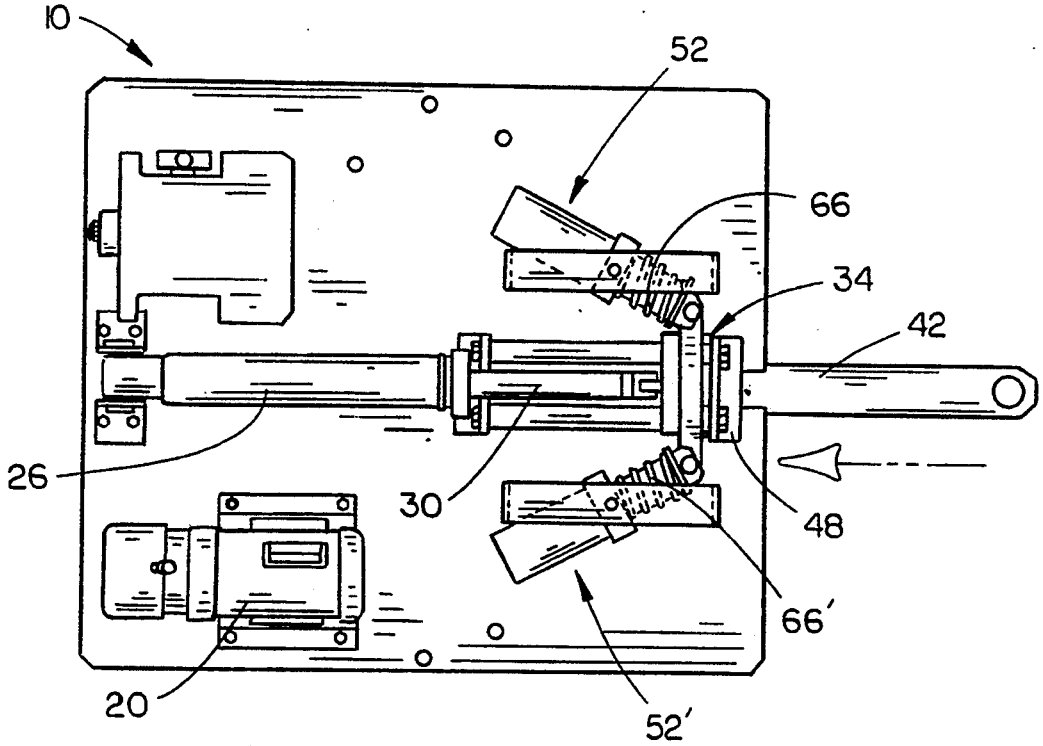
FIG. 4 is a top plan view similar to FIG. 3, with the switch in a thrown position.
Figure 5:
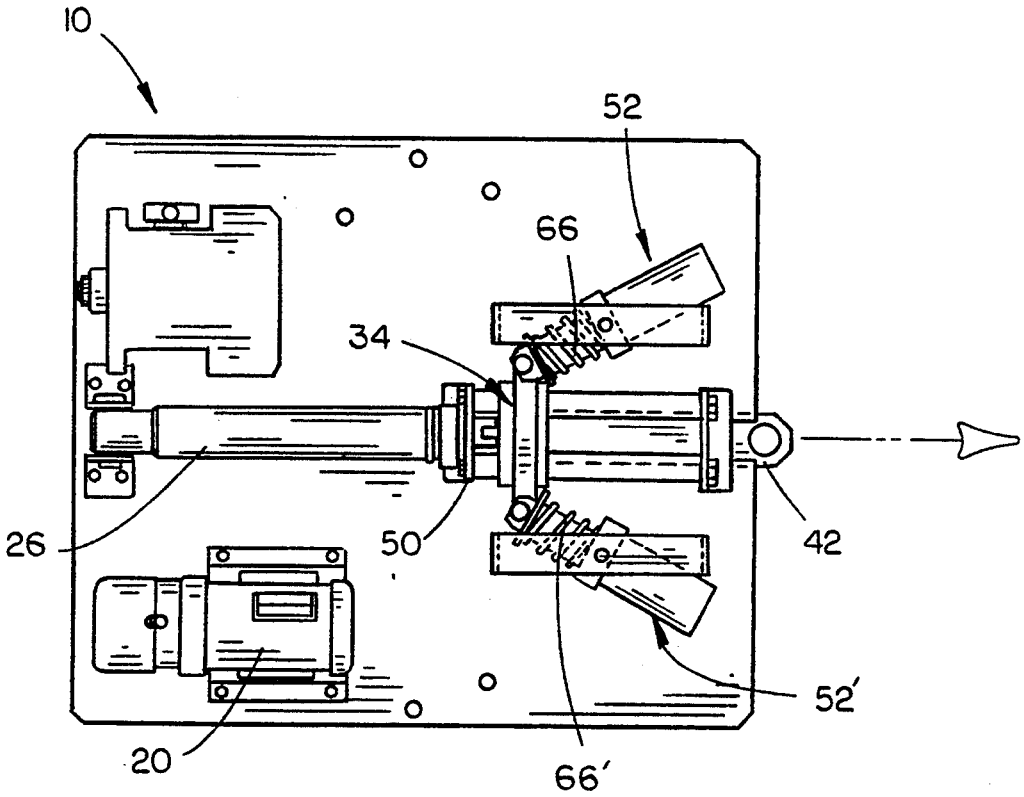
FIG. 5 is a view similar to FIG. 4 with the switch thrown in the opposite direction.

In operation, toggle arm 42 is initially in one of the two thrown positions shown in FIGS. 4 and 5. Assuming that throw arm 42 is in the position shown in FIGS. 2 and 4, the process of throwing a switch in the opposite direction would be as follows.

Lever arm 22 is pivoted from the neutral position shown in FIG. 2 to a rearward position, as indicated by arrow 80. This movement activates motor 20 to provide hydraulic power to valve mechanism 24 which is directed to cylinder 26 to retract extensible arm 30. Retraction of arm 30 will slide block 34 rearwardly along slot 38, and cause throw arms 52 and 52' to pivot about their vertical pivot axes. As throw arms 52 and 52' pivot, coil springs 66 and 66' will be compressed, as shown in FIG. 3. As block 34 moves rearwardly past the center point, wherein throw arms 52 and 52' are aligned along bar 78, hydraulic cylinder 26 will be operated to a neutral position, and coil springs 66 and 66' will decompress, forcing block 34 rearwardly into positive abutting contact with rearward bracket 50, as shown in FIG. 5. It can be seen that springs 66 and 66' provide a constant mechanical biasing force retaining block 34 in positive abutting contact with rearward bracket 50, and positively maintaining toggle 42 in one of the thrown positions.

Similarly, movement of lever 22 forwardly, as indicated by arrow 82 in FIG. 2. activates cylinder 26 so as to extend arm 30 beyond the intermediate point shown in FIG. 3, wherein springs 66 and 66' again take over to force block 34 forwardly into positive abutting contact with forward bracket 48, as shown in FIG. 4. Toggle 42 would then be positively maintained in the opposite thrown position.

Because hydraulic cylinder 26 is of a type which is in a neutral condition, other than when specifically activated by lever 22, a train run through will permit movement of toggle 42, and thus block 34 and arm 30, against the resistance of coil springs 66 and 66'. The coil springs 66 and 66' can be designed so as to maintain a predetermined positive biasing force which may be overcome by a train run through without damaging the components of switch stand 10. Yet, springs 66 and 66' will also maintain the toggle 42 in positive engagement in one of the two thrown positions, even after a train run through.

Referring once again to FIGS. 6 and 7, shaft 64 is utilized during assembly of switch stand 10 to retract clevis 70 and compress spring 66 so that clevis 70 may be pinned to the end of bar 78. This is accomplished by inserting a forward end of shaft 64 into threaded aperture 62 at the rearward end 60*a* of rod 60, and then rotating a washer/nut combination 82 onto the rearward end of shaft 64 until the combination abuts the rearward end of housing 54. As washer/nut combination 82 is threaded further along shaft 64, rod 60 will be pulled rearwardly within housing 54, thereby compressing spring 66. Once clevis 70 is connected to bar 78, shaft 64 is removed from throw arm 52.

Whereas the invention has been shown and described in connection with the preferred embodiment thereof, it will be understood that many modifications, substitutions and additions may be made which are within the intended broad scope of the appended claims. For example, pneumatic or electric cylinders may be utilized in substitution for the hydraulic cylinder shown and described. In addition, although hydraulic cylinder 26 is shown with a motor 20 utilized to power the hydraulics, lever 22 could be of a type permitting manual activation of the cylinder, through conventional reciprocating pumping action. There has therefore been shown and described an improved railway switch stand which accomplishes at least all of the above stated objects.

We claim:

1. A railway switch stand having a reciprocating toggle arm extending therefrom for operating a railway track switch between open and closed positions, comprising: a base plate having forward and rearward ends and upper and lower surfaces;

a block operably mounted on said base plate for reciprocating forward and rearward movement, one end of said toggle arm connected thereto for reciprocating movement therewith;

a forward and rearward bracket mounted on said base plate and located to prevent forward and rearward movement of said block beyond predetermined positions;

first means connected to said block for selectively moving said block between a forward position in contact with the forward bracket, and a rearward position in contact with the rearward bracket; and second means connected to said block, operable independently of said first means, for biasing said block into positive abutting contact with said forward bracket when the block is in the forward position, and for biasing said block into positive abutting contact with said rearward bracket when the block is in the rearward position.

2. The switch stand of claim 1, wherein said first means for selectively moving said block includes:

a hydraulic cylinder mounted on said base plate with a selectively extensible arm connected to said block; and an actuator mechanism operably connected to said cylinder to operate the cylinder and selectively extend and retract said arm to thereby move said block between the forward and rearward positions.

3. The switch stand of claim 2, wherein said cylinder includes a neutral condition wherein the arm may be extended and retracted by an outside force, and wherein said actuator mechanism includes means for activating the cylinder to move the arm from the forward position to a position retracted beyond the midway point between the forward and rearward positions and then to place the cylinder in a neutral condition, and to move the arm from the rearward position to a position extended beyond the midway point and then place the cylinder in a neutral condition, said mechanism maintaining the neutral condition of the cylinder until activated.

4. The switch stand of claim 1, wherein said second means for biasing said block includes first and second throw arms disposed on opposite sides of said block relative to the reciprocating path of the block, each said throw arm including:

an elongated housing having inward and outward ends;

an extensible rod projecting from the interior of said housing out a forward end thereof, having a forward end pivotally connected to said block for reciprocating movement therewith, said rod extensible between extended and retracted positions within the interior of said housing;

said housing being pivotally mounted on a vertical pivotal axis on said base plate; and means for biasing said forward rod end forwardly away from the rearward end of said housing;

said housing pivotal axes located equal distant from said block reciprocating axis, along a line perpendicular to the mid point of the block reciprocating axis.

5. The switch stand of claim 4, wherein each said throw arm biasing means includes:

a rearward stop plate mounted on the forward end of said housing;

a coil spring operably mounted around said rod having a rearward end and abutting contact with the stop plate; and a forward stop plate mounted on the forward end of the rod, with a forward end of said spring in abutting contact therewith;

said spring being compressible between said stop plates upon rearward movement of the rod into the housing.

6. The switch stand of claim 1, wherein said toggle arm is removably connected to said block.

7. The switch stand of claim 1, further comprising guide means located between said forward and rearward brackets for guiding said block along a reciprocating axis.

8. The switch stand of claim 7, wherein said guide means includes a pair of parallel rods extending between said brackets, and a pair of apertures in said block through which the guide rods are slidably journaled.

9. The switch stand of claim 1, wherein said base plate has a slot formed therein, and wherein said block has a stem portion projecting downwardly through said slot, said slot having a length to permit reciprocation of the block from the forward to rearward positions.

10. The switch stand of claim 9, wherein said toggle arm is connected to the projecting stem portion of the block.

* * * * *